US012435584B2

(12) United States Patent
Adil et al.

(10) Patent No.: US 12,435,584 B2
(45) Date of Patent: Oct. 7, 2025

(54) FIBER DEPLOYMENT AND MONITORING ON DEMAND WITH FRACTURING SPREAD CONTROL

(71) Applicant: Halliburton Energy Services, Inc., Houston, TX (US)

(72) Inventors: Faraaz Adil, Cypress, TX (US); Celso Max Trujillo, San Antonio, TX (US); Mikko K. Jaaskelainen, Houston, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 18/381,043

(22) Filed: Oct. 17, 2023

(65) Prior Publication Data

US 2025/0122770 A1 Apr. 17, 2025

(51) Int. Cl.
*E21B 23/00* (2006.01)
*E21B 47/135* (2012.01)

(52) U.S. Cl.
CPC ..... *E21B 23/001* (2020.05); *E21B 47/135* (2020.05)

(58) Field of Classification Search
CPC ..... E21B 23/001; E21B 47/135
See application file for complete search history.

(56) References Cited

U.S. PATENT DOCUMENTS 10,036,232 B2 7/2018 Dewitt et al.
10,883,810 B2 1/2021 Bouldin et al.
10,995,574 B2 5/2021 Jervis et al.
11,365,958 B2 6/2022 Bouldin et al.
11,469,823 B2 10/2022 Purkis
2007/0062696 A1 3/2007 Wilson et al.
2010/0025032 A1 2/2010 Smith et al.
2014/0203174 A1 7/2014 Skinner et al.
2014/0311755 A1* 10/2014 Al-Badran ..... E21B 23/14 166/381
2016/0097275 A1 4/2016 Santoso
2016/0362953 A1* 12/2016 Bedrossian ..... E21B 4/18
2017/0145760 A1* 5/2017 Poyet ..... E21B 19/008
2019/0368290 A1 12/2019 Vick, Jr. et al.

OTHER PUBLICATIONS

International Search Report & Written Opinion; PCT Application No. PCT/US2023/035415; mailed Jul. 3, 2024.

* cited by examiner

*Primary Examiner* — D. Andrews
(74) *Attorney, Agent, or Firm* — NOVAK DRUCE CARROLL LLP

(57) ABSTRACT

Described herein are systems and techniques related to a propulsion device that moves equipment along a wellbore. While wellbore equipment may be deployed in a wellbore using gravity or with the flow of a fluid like drilling mud, in certain instances, such techniques are not well suited to this task. Systems and techniques of the present disclosure may be applied to deploy tools in a wellbore by controlling motion of a self-propelled device along the wellbore. This may include using wheels, tracks, propellers, impellers, or other devices to propel tools into a wellbore even when the wellbore has perforations that may disrupt conventional deployment techniques. Techniques of the present disclosure may include transferring power to a wellbore apparatus via one or more elements of a fiber optic cable.

20 Claims, 7 Drawing Sheets

FIBER DEPLOYMENT AND MONITORING ON DEMAND WITH FRACTURING SPREAD CONTROL

TECHNICAL FIELD

The present disclosure is generally directed to controlling motion of devices deployed in a wellbore. More specifically, the present disclosure relates to methods and apparatus where a propulsion device is controlled to move equipment in the wellbore.

BACKGROUND

Tools may be deployed in a wellbore using the effects of gravity or the movement fluids (e.g., drilling muds) down the wellbore, or a combination and fluid movement may be used to deploy wellbore tools. Each of these deployment methods has limitations. A limitation associated with using gravity to deploy tools is that gravity cannot be used to lower a tool into a wellbore that moves in a horizontal direction. Deploying tools using fluids also has limitations as flow of the fluids may be turbulent or wellbores that have perforation may have non-uniform fluid flow. Since turbulent flow or non-uniform flows may affect the efficiency of deploying a tool, the use of fluids to deploy the tools may not be effective.

Furthermore, conventional techniques for deploying fiber optic cables may require pumps and skilled labor to deploy and pump in fiber optic cables into monitoring wells. As such, it is desirable to reduce this complexity to scale deployment of fiber optic cables. Current fracturing operations operate across a number of wells and pads simultaneously, and scheduling with pumps for rig-up and deployment is complex when combined with everything else happening at a drilling location, wellbore operators are exposed to significant challenges when deploying tools in wellbores.

BRIEF DESCRIPTION OF THE DRAWINGS

In order to describe the manner in which the features and advantages of this disclosure can be obtained, a more particular description is provided with reference to specific implementations thereof which are illustrated in the appended drawings. Understanding that these drawings depict only exemplary implementations of the disclosure and are not therefore to be considered to be limiting of its scope, the principles herein are described and explained with additional specificity and detail through the use of the accompanying drawings in which.

DETAILED DESCRIPTION

Figure 1A:
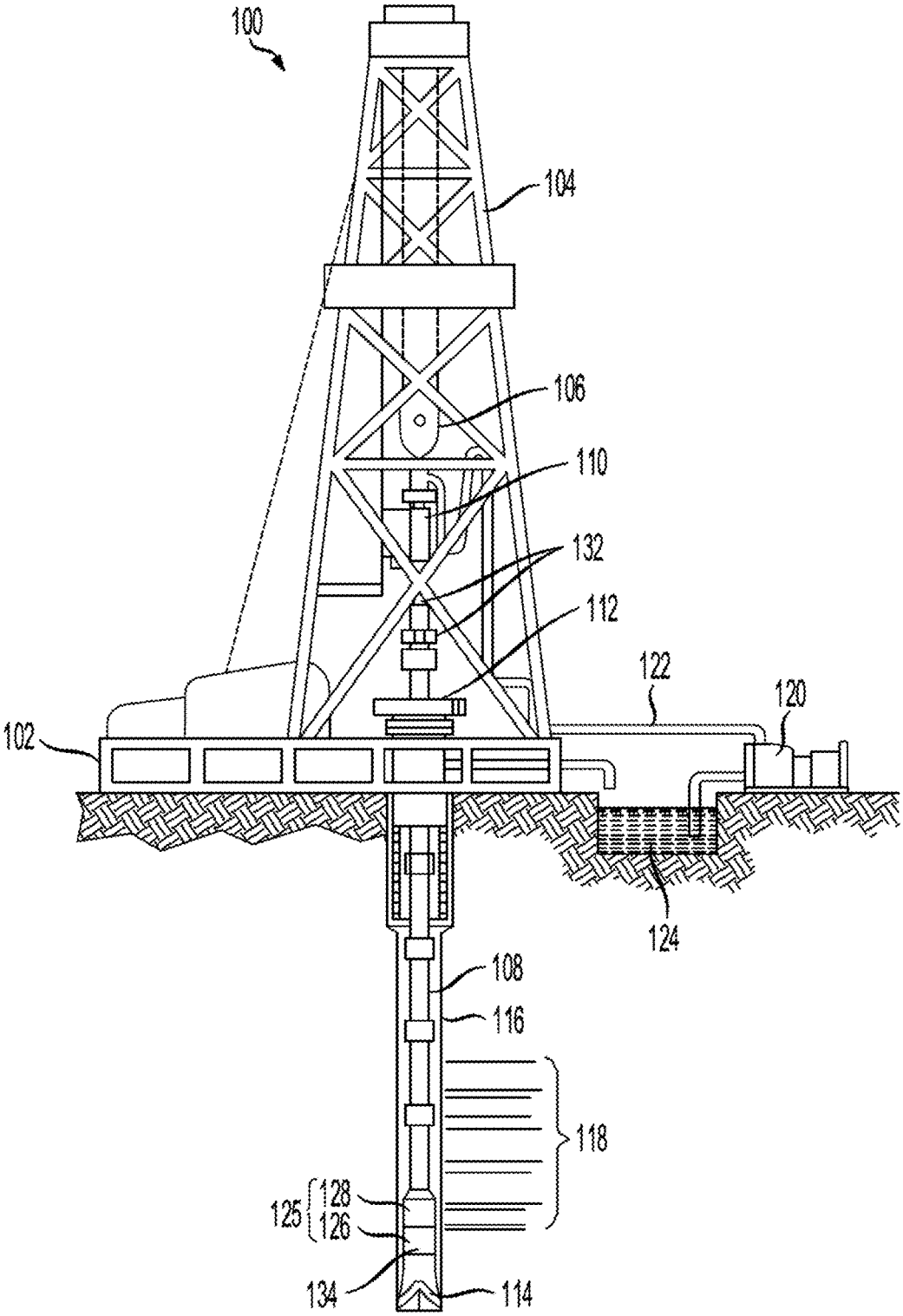
FIG. 1A is a schematic diagram of an example logging while drilling wellbore operating environment, in accordance with various aspects of the subject technology.

Various aspects of the disclosure are discussed in detail below. While specific implementations are discussed, it should be understood that this is done for illustration purposes only. A person skilled in the relevant art will recognize that other components and configurations may be used without parting from the spirit and scope of the disclosure.

Additional features and advantages of the disclosure will be set forth in the description which follows, and in part will be obvious from the description, or can be learned by practice of the principles disclosed herein. The features and advantages of the disclosure can be realized and obtained by means of the instruments and combinations particularly pointed out in the appended claims. These and other features of the disclosure will become more fully apparent from the following description and appended claims or can be learned by the practice of the principles set forth herein.

It will be appreciated that for simplicity and clarity of illustration, where appropriate, reference numerals have been repeated among the different figures to indicate corresponding or analogous compounds. In addition, numerous specific details are set forth in order to provide a thorough understanding of the methods and apparatus described herein. However, it will be understood by those of ordinary skill in the art that the methods and apparatus described herein can be practiced without these specific details. In other instances, methods, procedures, and components have not been described in detail so as not to obscure the related relevant feature being described. The drawings are not necessarily to scale, and the proportions of certain parts may be exaggerated to better illustrate details and features. The description is not to be considered as limiting the scope of the present disclosure.

Described herein are systems, apparatuses, processes (also referred to as methods), and computer-readable media (collectively referred to as "systems and techniques") for a propulsion device that moves equipment along a wellbore. While wellbore equipment may be deployed in a wellbore using gravity or with the flow of a fluid like a drilling mud, in certain instances, such techniques are not well suited to this task. For example, when a wellbore has perforations in the side of a wellbore casing, a flow of fluids through those holes may interfere with the deployment of the wellbore equipment. To deploy wellbore equipment in a wellbore, systems and techniques of the present disclosure control a propulsion device to control movement of wellbore equipment.

These systems and techniques may be applied to facilitate or improve wellbore operations, including, yet not limited to hydraulic fracturing, hydrocarbon production, and carbon sequestration. In various instances, unconventional reservoirs must be hydraulically fractured in order to allow commercially viable volumes of hydrocarbons to be produced. In such instances it is often desirable to access and connect with as much reservoir rock as possible through proper well placement, well completion design, and optimized fracturing operations.

When a well is drilled into a reservoir, a casing is often inserted and cemented in place. Cement may be pumped down the center of the casing and forced out into an annular space around an outer portion of the casing. This process may be used for vertical wells and similar processes may be used when making horizontal shale wells. Each well may be divided into a predetermined number of segments called stages where each stage may have a completion design with a number of pathways connecting the inside of the casing with the formation. The hydraulic fracturing process may be executed on a stage basis where the first step may include making penetrations into formations that surround the wellbore. This may include using perforation charges to blast through the casing and cement layer into the surrounding reservoir rock.

Fracturing operations may be designed to pump a specific amount of fracturing fluid into each stage in a reservoir (or each perforation cluster) with a given well spacing and completion design with the intent to contact a targeted reservoir volume with fractures. Fracturing operations may include controlling fluid flow rates, pressures, chemical composition and proppant concentration of fluids at each stage of the wellbore. Chemicals used in this process may include friction reducers that reduce frictional pressure losses along the casing, this may allow pumps to operate at lower surface pressure while meeting subsurface pressures required to fracture the rock. Other chemicals may change viscosity and properties to enable better proppant transport as the fracturing fluid is pumped through the casing, perforations and into the formation.

General reservoir properties may be understood from seismic surveys, electromagnetic surveys, wireline logging runs, and core samples, for example. Knowing these properties allows reservoirs to be developed according to plans intended to maximize production of a given field of wellbores. Many reservoirs may have existing wells in the same or neighboring reservoir layers where pressure may be locally reduced due to production and all reservoirs may be inhomogeneous to various degrees. Future wells may be placed in areas where reservoir characteristics are more complex as many sweet spots with good reservoir conditions may already be drilled.

It is therefore desirable to monitor fracturing operations using, for example, low frequency strain monitoring in order to verify that the generated fractures are being placed per the plan given the various uncertainties. One practical and cost-effective technology for fracture monitoring is based on distributed acoustic sensing (DAS) with the optical sensing fiber cables in monitoring wells.

Conventional techniques for deploying fiber optic cables may require pumps and skilled labor to deploy and pump in fiber optic cables into monitoring wells. As such, it is desirable to reduce this complexity to scale deployment of fiber optic cables. Current unconventional fracturing operations operate across a number of wells and pads simultaneously, and scheduling with pumps for rig-up and deployment is complex when combined with everything else happening on a pad or across multiple pads.

It is also in many cases desirable to deploy tools that deploy fiber on demand in monitoring wells during ongoing fracturing operations as fractures may grow in unexpected directions. Because of this, it may be essential have the appropriate subsurface insight through monitoring in order to control fracturing operations. The complexity of existing fiber optic cable deployment methods limits the ability to deploy fiber optic tools on demand to meet monitoring needs. It may also be desirable to deploy fiber optic cables in perforated wells to measure production, injection or well interference effects. Deploying such cables or other equipment in wells that have perforations may be very difficult, fluids flowing through these perforations can interfere with motion of the cable or tools. It may be desirable to deploy a fiber optic cable, a pump, or other apparatus into the wellbore to monitor wellbore operations or to facilitate a hydraulic fracturing operation. For example, such tools may direct fracturing fluid into a specific set of fractures, deploy charges directly into fractures, accelerate particles of specific densities into fractures, or perform other operations on a wellbore. As such, the present disclosure is directed to the design and construction of tools capable of deploying fiber optic cables and/or other equipment into a wellbore. It may also be desirable to use tools may be disposed of in the wellbore after they are used.

FIG. 1A is a schematic diagram of an example logging while drilling wellbore operating environment. The drilling arrangement shown in FIG. 1A provides an example of a logging-while-drilling (commonly abbreviated as LWD) configuration in a wellbore drilling scenario 100. The LWD configuration can incorporate sensors (e.g., EM sensors, seismic sensors, gravity sensor, image sensors, etc.) that can acquire formation data, such as characteristics of the formation, components of the formation, etc. For example, the drilling arrangement shown in FIG. 1A can be used to gather formation data through an electromagnetic imager tool (not shown) as part of logging the wellbore using the electromagnetic imager tool. The drilling arrangement of FIG. 1A also exemplifies what is referred to as Measurement While Drilling (commonly abbreviated as MWD) which utilizes sensors to acquire data from which the wellbore's path and position in three-dimensional space can be determined. FIG. 1A shows a drilling platform 102 equipped with a derrick 104 that supports a hoist 106 for raising and lowering a drill string 108. The hoist 106 suspends a top drive 110 suitable for rotating and lowering the drill string 108 through a well head 112. A drill bit 114 can be connected to the lower end of the drill string 108. As the drill bit 114 rotates, it creates a wellbore 116 that passes through various subterranean formations 118. A pump 120 circulates drilling fluid through a supply pipe 122 to top drive 110, down through the interior of drill string 108 and out orifices in drill bit 114 into the wellbore. The drilling fluid returns to the surface via the annulus around drill string 108, and into a retention pit 124. The drilling fluid transports cuttings from the wellbore 116 into the retention pit 124 and the drilling fluid's presence in the annulus aids in maintaining the integrity of the wellbore 116. Various materials can be used for drilling fluid, including oil-based fluids and water-based fluids.

Logging tools 126 can be integrated into the bottom-hole assembly 125 near the drill bit 114. As drill bit 114 extends into the wellbore 116 through the formations 118 and as the drill string 108 is pulled out of the wellbore 116, logging tools 126 collect measurements relating to various formation properties as well as the orientation of the tool and various other drilling conditions. The logging tool 126 can be applicable tools for collecting measurements in a drilling scenario, such as the electromagnetic imager tools described herein. Each of the logging tools 126 may include one or more tool components spaced apart from each other and communicatively coupled by one or more wires and/or other communication arrangement. The logging tools 126 may also include one or more computing devices communicatively coupled with one or more of the tool components. The one or more computing devices may be configured to control or monitor a performance of the tool, process logging data, and/or carry out one or more aspects of the methods and processes of the present disclosure.

The bottom-hole assembly 125 may also include a telemetry sub 128 to transfer measurement data to a surface receiver 132 and to receive commands from the surface. In at least some cases, the telemetry sub 128 communicates with a surface receiver 132 by wireless signal transmission (e.g., using mud pulse telemetry, EM telemetry, or acoustic telemetry). In other cases, one or more of the logging tools 126 may communicate with a surface receiver 132 by a wire, such as wired drill pipe. In some instances, the telemetry sub 128 does not communicate with the surface, but rather stores logging data for later retrieval at the surface when the logging assembly is recovered. In at least some cases, one or more of the logging tools 126 may receive electrical power from a wire that extends to the surface, including wires extending through a wired drill pipe. In other cases, power is provided from one or more batteries or via power generated downhole.

Collar 134 is a frequent component of a drill string 108 and generally resembles a very thick-walled cylindrical pipe, typically with threaded ends and a hollow core for the conveyance of drilling fluid. Multiple collars 134 can be included in the drill string 108 and are constructed and intended to be heavy to apply weight on the drill bit 114 to assist the drilling process. Because of the thickness of the collar's wall, pocket-type cutouts or other type recesses can be provided into the collar's wall without negatively impacting the integrity (strength, rigidity and the like) of the collar as a component of the drill string 108.

Figure 1B:
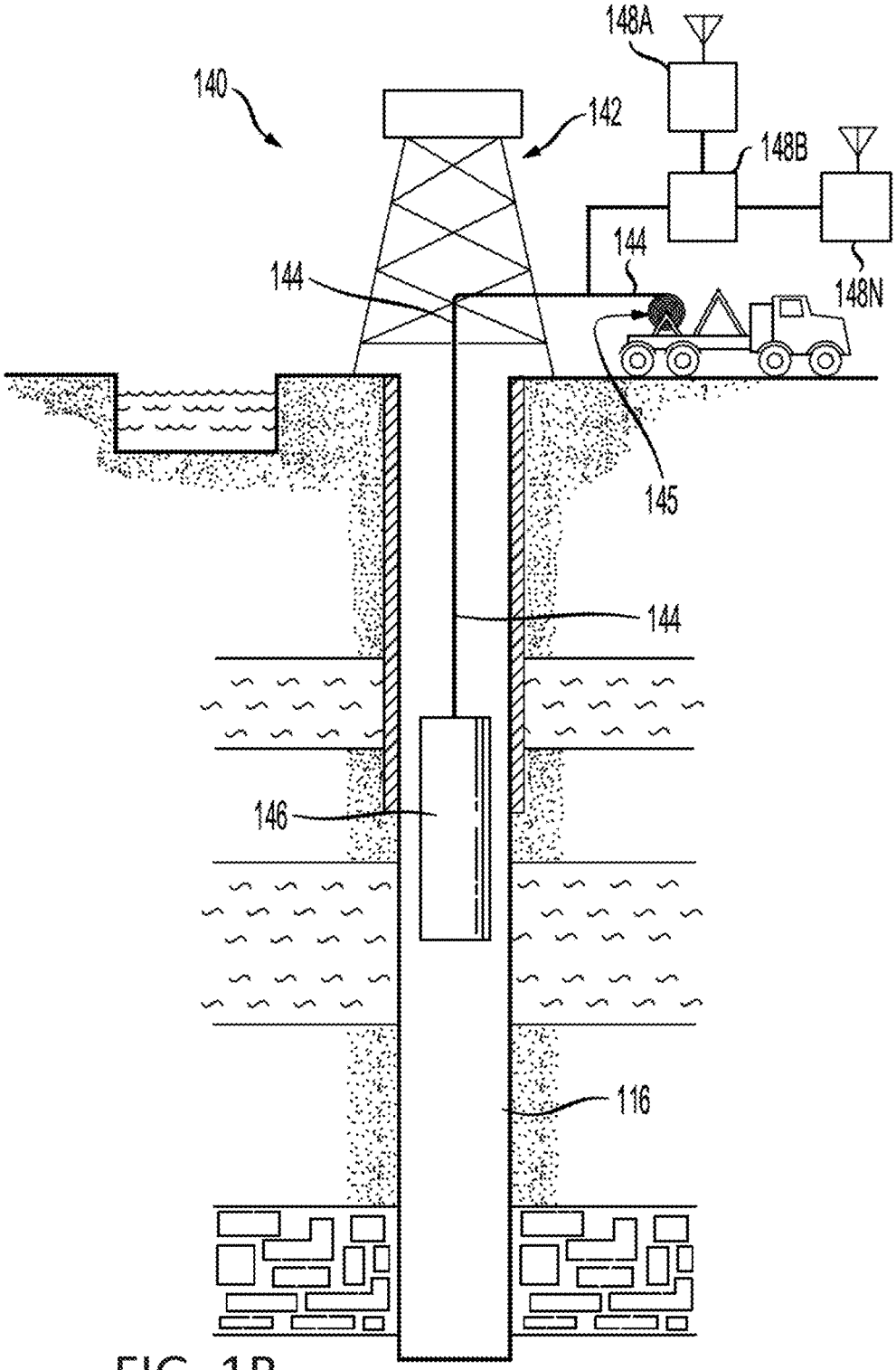
FIG. 1B is a schematic diagram of an example downhole environment having tubulars, in accordance with various aspects of the subject technology.

FIG. 1B is a schematic diagram of an example downhole environment having tubulars. Here, an example system 140 is depicted for conducting downhole measurements after at least a portion of a wellbore has been drilled and the drill string removed from the well. An electromagnetic imager tool (not shown) can be operated in example system 140 shown in FIG. 1B to log the wellbore. A downhole tool is shown having a tool body 146 in order to carry out logging and/or other operations. For example, instead of using the drill string 108 of FIG. 1A to lower the downhole tool, which can contain sensors and/or other instrumentation for detecting and logging nearby characteristics and conditions of the wellbore 116 and surrounding formations, a wireline conveyance 144 can be used. The tool body 146 can be lowered into the wellbore 116 by wireline conveyance 144. The wireline conveyance 144 can be anchored in the drill rig 142 or by a portable means such as a truck 145. The wireline conveyance 144 can include one or more wires, slicklines, cables, and/or the like, as well as tubular conveyances such as coiled tubing, joint tubing, or other tubulars. The downhole tool can include an applicable tool for collecting measurements in a drilling scenario, such as the electromagnetic imager tools described herein.

The illustrated wireline conveyance 144 provides power and support for the tool, as well as enabling communication between data processors 148A-N on the surface. In some examples, the wireline conveyance 144 can include electrical and/or fiber optic cabling for carrying out communications. The wireline conveyance 144 is sufficiently strong and flexible to tether the tool body 146 through the wellbore 116, while also permitting communication through the wireline conveyance 144 to one or more of the processors 148A-N, which can include local and/or remote processors. The processors 148A-N can be integrated as part of an applicable computing system, such as the computing device architectures described herein. Moreover, power can be supplied via the wireline conveyance 144 to meet power requirements of the tool. For slickline or coiled tubing configurations, power can be supplied downhole with a battery or via a downhole generator.

Figure 2:
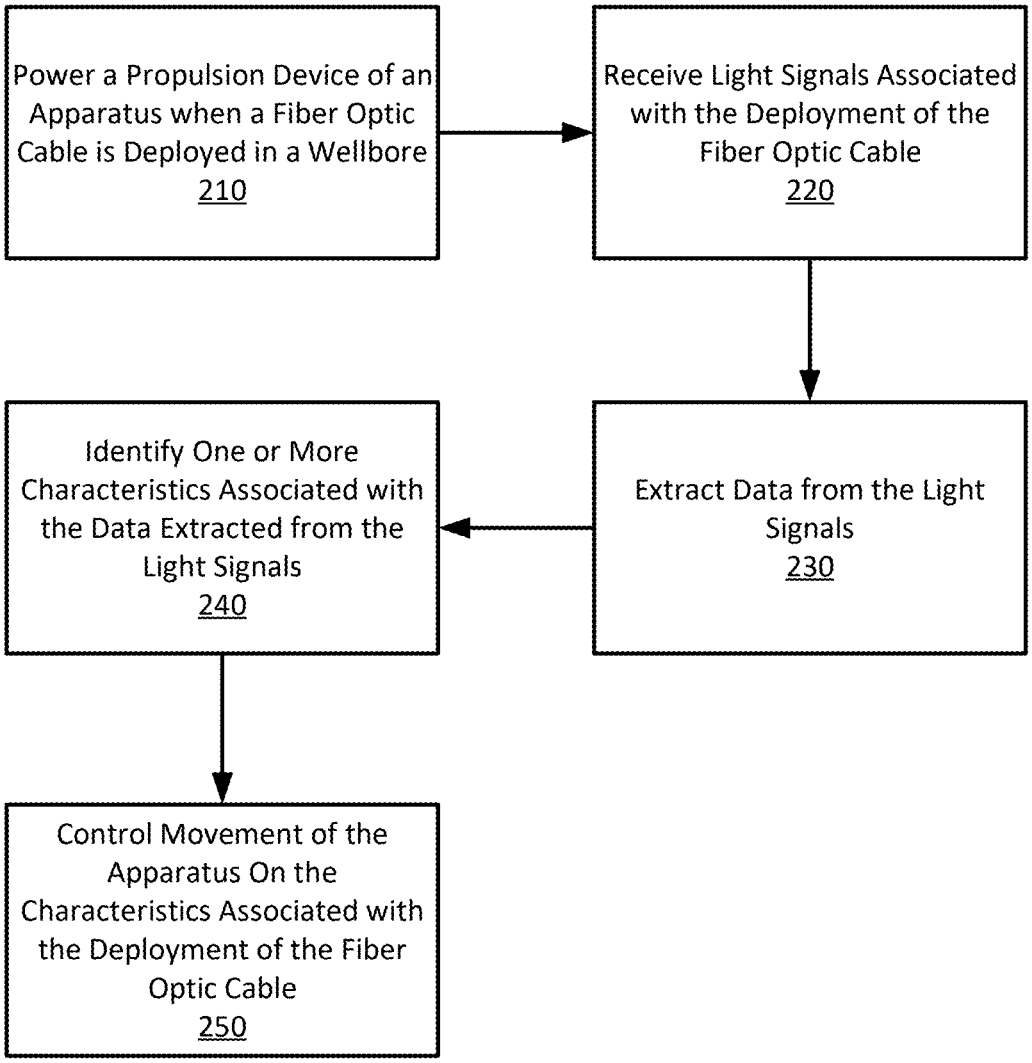
FIG. 2 illustrates actions that may be performed when a propulsion device moves equipment along a wellbore, in accordance with various aspects of the subject technology.

FIG. 2 illustrates actions that may be performed when a propulsion device moves equipment along a wellbore. At block 210 a propulsion device of an apparatus may be powered when a fiber optic cable is deployed in a wellbore. Such a propulsion device may include a propeller, an impeller, and/or wheels that may be driven by one or more motors. The propulsion device may be powered when the propulsion device moves down a vertical portion of the wellbore. Because of this, equipment attached to the propulsion device may provide a force that helps move or direct the equipment down the vertical portion of the wellbore and then along other sections of the wellbore.

The propulsion device and the equipment that the propulsion device moves may be prepped for deployment at the surface of the Earth, the wellbore may have a path that extends vertically down, or this path may be circuitous with side to side or up and down undulations. As such, the wellbore may be characterized as having an upper portion, vertical descending portions, horizontal portions, and/or portions that have some inclination relative to a horizontal plane located at the surface of the Earth.

In certain instances, the force provided by the propulsion device may be in a direction that is opposite to the force of gravity or a force of fluids pumped into or moving along the wellbore. When the wellbore equipment is deployed in a vertical portion of the wellbore, gravity may exert a maximum force that pulls that equipment down the wellbore. Unless restrained by some other force, the wellbore equipment could fall into the wellbore. To forestall such an event, conveyance apparatus like the wireline conveyance 144 (or tether) of FIG. 1B may be used to prevent the uncontrolled deployment of the equipment in the wellbore. Such a device, however, may interfere with the operation of a propulsion device that is configured to deploy the equipment. In instances when a wireline conveyance is used it may be configured to release lengths of wire when a force greater than a restraining force to pull additional wire from the wireline conveyance. This may be similar to a drag force setting of a fishing reel. As such, the restraining force resists free movement of equipment being deployed. Because of this, a propulsion device may have to provide a force that is greater than the restraining force to move the equipment along the wellbore. This could result in wasting power as power would be required to overcome the restraining force. Power that allows wellbore equipment to operate may limited in certain circumstances, so applying power to overcome limitations of a safety precaution may not be an appropriate use of resources.

A similar issue arises when wellbore fluids (e.g., drilling muds) are used to help push equipment down a wellbore. The flow of fluid down the wellbore may result in the equipment moving faster down the wellbore than a given process requires. Even though controlling the rate at which fluids are provided to the wellbore may help mitigate uncontrolled motion of equipment, a certain flow rate or mass flow rate of fluid may be desired, and these flow rates may not be consistent with a desired deployment velocity of the equipment.

To balance limitations associated with certain specific wellbore configurations and operations, a propulsion device may provide a force that either moves the equipment down (further into) the wellbore, that moves the equipment up the wellbore, or that resists movement of the equipment along the wellbore. For example, in an instance when the equipment is deployed in the wellbore when a drilling fluid is provided to the wellbore, the propulsion device may provide a force in the opposite direction that the drilling fluid moves. This may include powering a propeller or impeller to provide a force in the opposite direction to the fluid flow. This could act as a stabilizing force that helps steady the motion of the equipment. Such a stabilizing force may help prevent rotational motion of the equipment relative to the sidewall of a wellbore or wellbore casing. This is because a force in an opposite direction to the fluid flow may prevent the fluid from pushing one end of the equipment toward the wellbore sidewall. This opposite flow may result in a laminar flow of the fluid around the equipment and may help mitigate turbulence of the fluid flow in the vicinity of the equipment.

In instances when a wheeled or track like conveyance is used, motion of the wheels or tracks may limit the velocity that the equipment moves along the wellbore. Here again, the propulsion device may prevent the equipment from moving at the same velocity as the fluid flow or may help power the equipment to move in a direction that is opposite to the fluid flow. Similar situations may arise with the wellbore does not include flowing fluids, the direction of a propeller or other powered conveyance (e.g., impeller, wheels, or tracks) deployed in the wellbore may resist or act against the force of gravity.

As such the powering of the propulsion device at block 210 may result in the propulsion device generating a control force that assists motion in a direction, that counters motion in that direction, and/or that stabilized motion of wellbore apparatus. This may be done to control velocity of deployment of equipment in a wellbore or to stabilize motion of that equipment when the equipment is located in the wellbore.

As the propulsion device helps control motion of the apparatus down the wellbore, a fiber optic cable may be deployed. One or more elements (e.g., individual strands of fiber optic cable) of this fiber optic cable may be provided with light from a laser that travels along those elements until that light reflects off a distal (far) end of those elements. Forces that act upon these elements disrupt the light that travels along the elements. As such, light signals that are received at an upper (near) end of the cable have patterns that correspond to the forces that acted upon the elements. When the fiber optic cable is deployed, it may be deployed from a deployment device (e.g., a spool) that releases the cable. The deployment of the cable generates forces on the cable that imposes patterns in light signals that the elements of the cable carries. As such from these patterns, various metrics associated with the deployment of the cable may be identified.

At block 220, light signals associated with the deployment of the fiber optic cable may be received. As mentioned above, these light signals may include patterns associated with cable deployment forces. When the fiber optic cable is wrapped around a spool, light traveling along the cable may be disrupted in a manner that imposes a repeating pattern on to the light signals. At block 230, data may be extracted from the light signals and this pattern may be used to identify one or more characteristics associated with the data extracted from the light signals.

Such a pattern may repeat for each revolution of the cable as the cable is pulled off the spool or other dispenser. The pattern may correspond to an effective diameter of the spool. The effective diameter of the spool may correspond to an actual spool diameter plus a distance associated with plurality of wraps of fiber optic cable around the spool. While the effective diameter of the spool may reduce as the cable is deployed, a velocity of the apparatus being deployed in the wellbore will correspond to a repetition period of the pattern. Furthermore, a number of repeating patterns may be used to identify the length of cable that has been deployed. As such, the data extracted from the light signals may be used to identify velocities of the apparatus and deployment lengths of the cable as the cable is deployed. Calculations to identify these velocities and deployment lengths may compensate for the effective diameter of the spool changing over deployed length. As such, velocity and deployed length are two characteristics that can be identified from data extracted at block 230 from received light signals. Because of this, one or more characteristics associated with the data extracted from the light signals may be identified at block 240.

Once a characteristic, such as velocity or deployed length has been identified, movement of the apparatus may be controlled based on that velocity or deployed length at block 250. In one instance, this velocity may be controlled based on an amount of power that is provided a motor that controls the propulsion device. Alternatively, or additionally, the velocity of the apparatus may be changed as the apparatus reaches an area of the wellbore. In an instance when a hole is located at approximately 1050 feet from the upper portion of the wellbore, the velocity of the apparatus may be slowed when the deployed length of the cable is 1045 meters. At this point, the apparatus may be moved more slowly until the apparatus is located at the hole. This may allow for corrective actions or some other wellbore operation to be performed.

Figure 3:
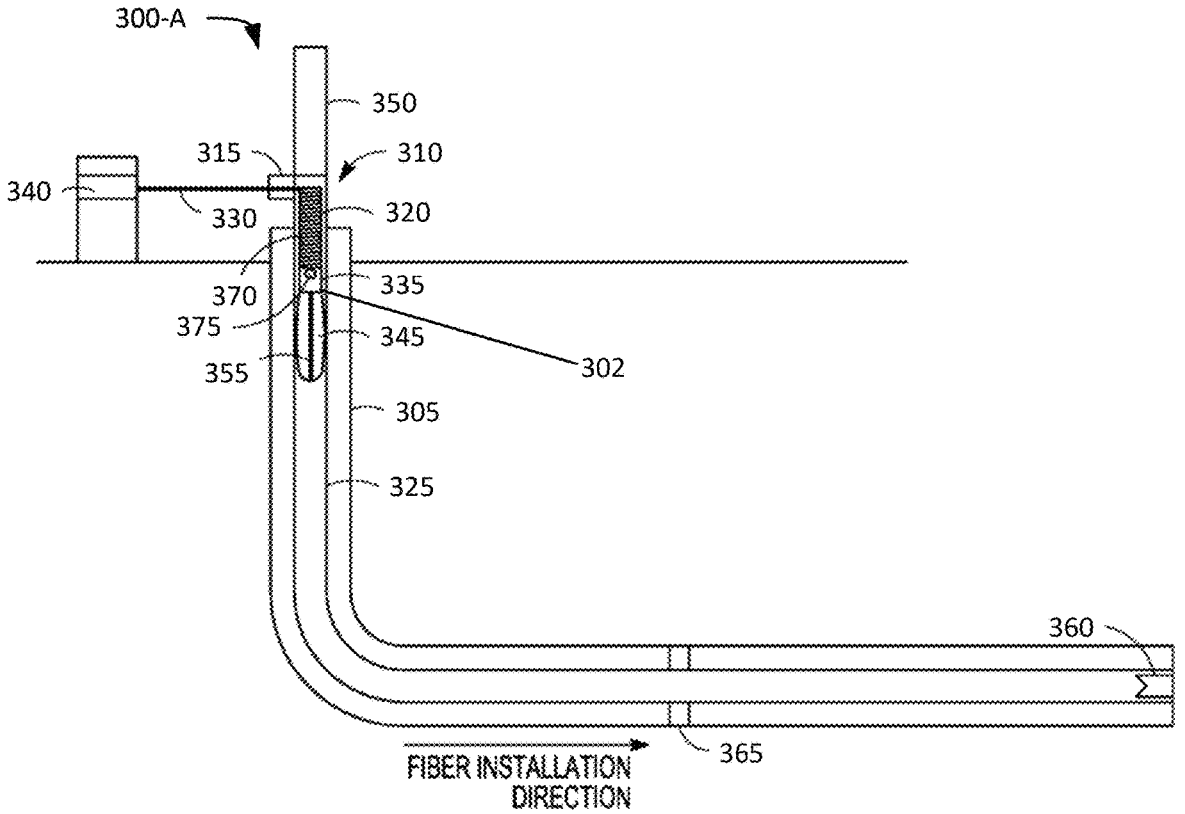
FIG. 3 illustrates a fiber dispensing apparatus that may be deployed in a wellbore, in accordance with various aspects of the subject technology.
Figure 3:
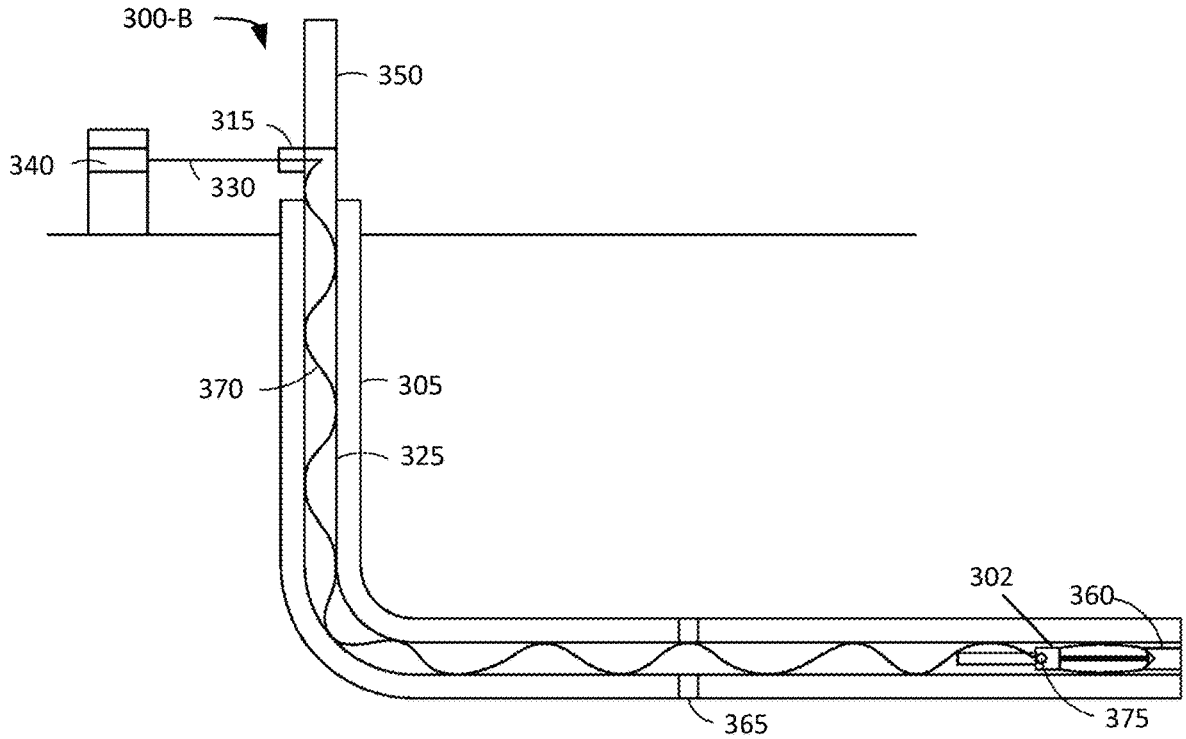

FIG. 3 illustrates a fiber dispensing apparatus that may be deployed in a wellbore. Image 300-A of FIG. 3 illustrates an apparatus 302 that is about to dispense optical fiber 370 into well 305 and image 300-B of FIG. 3 illustrates the same apparatus 302 that has dispensed optical fiber 370 into well 305. Fiber optic cable 370 may be a fiber optic cable that includes one or more optical elements. These one or more optical elements may include one or more fiber optic elements that is/are used for sensing and may include one or more fiber optic elements that is/are used to transfer power to the apparatus 302.

Well 305 may be a cased hole or an uncased hole. Such a method can be employed with or without the use of coiled tubing equipment for deployment. In certain instances, a fiber spooler mechanism 310 can be used to dispense fiber optic cable 370. The fiber spooler 310 can include motor 335, a spool 320 (around which optical fiber optic cable 370 may be wound), and propulsion mechanism 345 (e.g., a propeller, impeller, wheels, or track). Such apparatus may also include a neutral buoyancy float that can be made of syntactic foam with a density calculated to provide neutral buoyancy of the entire fiber spooler mechanism 310. Thus, the apparatus 302 may neither float nor sink in wellbore fluids that may be used to assist deployment of fiber optic cable 370. Motor 335 may be electrically powered such that active areas 355 of propulsion mechanism 345 may engage the side surfaces of well 305, or active areas 355 may be parts of a propeller that pushes or pulls drilling fluids. A portion 330 of fiber optic cable 370 may be attached to devices 340 at the surface of well 305 such that light power may be sent to deployed tools or such that fiber optic cable 370 may provide light signals to sensing devices.

Initially, fiber spooler mechanism 310 may be mounted in a spooler launcher 350. The spooler launcher 350 can be used to insert the fiber spooler 310 in the production string 325 of well 305. The optical fiber 370 can be anchored at the surface by mounting an end of the optical fiber 370 to a well head exit 315. When the apparatus 302 of FIG. 3 is deployed, power may be applied to motor 335 such that fiber spooler 310 starts to move downhole while apparatus 302 is deployed. This action may result in the optical fiber 370 being unwound in a spiral fashion. With this fiber spooler mechanism 310, the relationship between rotational velocity and linear deployment velocity can be controlled.

The fiber spooler 310 continues to unwind the optical fiber 370 until it reaches the bottom of the hole, where a catcher 360 may lock the apparatus 302 on to the end of the fiber spooler 310 to prevent further movement. In certain instances, the catcher may be controllably released by a release mechanism. In certain instances, after the optical fiber cable 370 is laid with the arrival of the fiber spooler 310 at the end of the well 305, the fiber spooler 310 may not be retrieved. The fiber spooler 310 may also contain a fiber optic pressure transducer 375, which may measure pressures of well 305. Other optional transducers may include 3 axis seismic sensors. Areas where hydraulic fracturing may be located near the catcher 360 or at intermediate locations 365 of well 305.

Figure 4:
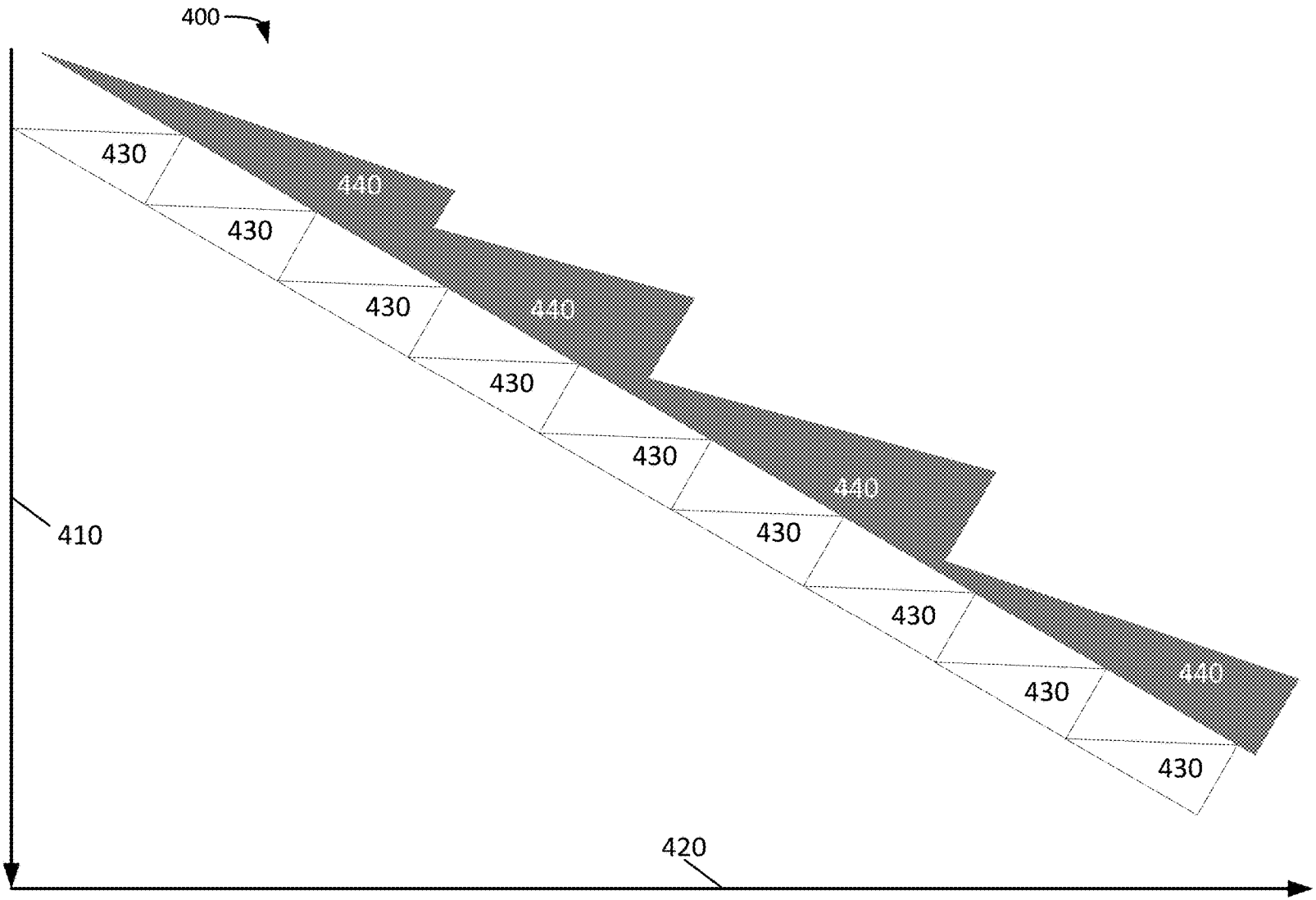
FIG. 4 illustrates patterns that may be included in light signals received from a fiber optic cable when the fiber optic cable is deployed with a controlled velocity, in accordance with various aspects of the subject technology.

FIG. 4 illustrates patterns that may be included in light signals received from a fiber optic cable when the fiber optic cable is deployed with a controlled velocity. As mentioned above, these patterns may repeat as the cable spools off of a spool around which the cable is wrapped. Image 400 of FIG. 4 may have been generated from data acquired by sampling a received light signal as the cable was deployed in a wellbore. Image 400 includes vertical axis 410 of deployed cable length and a horizontal axis 420 of time. When a fiber optic cable is deployed, the length of the cable wrapped on a spool, a spool diameter, and the diameter of the cable may be known. As the cable unwraps from the spool, forces applied on the cable may vary in a manner that causes changes in light carried by the cable. As such, light signals received by an apparatus located at the top of a wellbore will vary based on these changing forces inducing strain in the cable. This light signal may be sampled, and data acquired from those samples may correspond to the triangle shapes 430 in image 400. As such a length of deployed cable at any moment in time may be identified or estimated based on a number of triangle shapes in image 400. In one instance, an effective diameter of the spool may be about 2 to 3 inches when this spool wound with an optical cable. In some instances, an optical cable may include 2 or more independent optical fibers or cables where one may be used for optical power and the other(s) may be used for sensing. The optical power fiber may have a core size, for example, up to 105 micro-meter (um) core outer diameter (OD) with a 125 um OD cladding and a buffer protecting the optical fiber. This buffer may have an OD between 155 μm to 245 μm, for example. The normal sensing fiber may be a single mode (SM) fiber with a 8-10 um core, 125 um cladding, and 155-245 um buffer; or a multi-mode (MM) fiber with a 50-62.5 um core, 125 um cladding and 155-245 um buffer.

Light carried along a fiber optic cable may have patterns that are characteristic of a state of deployment of the cable and data associated with these states may correspond to a signature that may be used to identify a current state of the cable. In one instance, a signature associated with the fiber wound on a spool may be different than a signature associated with fiber that is deployed. The characteristic triangle shaped patterns included in FIG. 4 may correspond to a strain and/or attenuation pattern that can be measured. This pattern may largely disappear when deployment of the cable is paused or complete. As such, a pattern associated with cable deployment may no longer be clearly visible after the cable is deployed. Optical time domain reflectometry (OTDR) measurements may be used to detect such patterns, and this may include sending out a pulse and measuring the travel time of the pulse in the fiber to the location of an interface, this interface may be tracked over time to identify a velocity of the cable deployment. Rayleigh based OTDR at, for example, 1625 nm may provide measurements when 2-3 inch diameter coil of fiber is used. Alternatively, or additionally, Rayleigh based distributed acoustic sensing or Brillouin based techniques may be used to measure strain in the fiber as the cable comes off a spool.

Since the pattern repeats as a function of cable spooling off a spool, measurements over time may allow a processor executing instructions to generate image 400. Alternatively, or additionally, the processor may also identify a rate of cable deployment that corresponds to a deployment velocity and the processor may also identify a total length of deployed cable. The triangular shapes 440 in image 400 may have been generated by forces associated with the cable moving or flapping behind an apparatus that is being deployed in the wellbore. Other signatures may be visible depending on spool construction and size as well as deployment velocity and wellbore conditions.

An apparatus deployed in a wellbore may use power from one or more power sources. In some instances, power may be provided by a power storage device (e.g., a battery or a supercapacitor) located at the apparatus. Alternatively, or additionally, the apparatus may receive power from one or more of elements of the fiber optic cable and a power storage device.

When power is received optically, techniques such as remote optical pumping with optical to electrical conversion (photonic power) may be used. Power may be supplied to energize an electro-mechanical propulsion system that can be used for fiber deployment. The system may use multiple optical fibers where one or more fibers may be used for transmitting the optical power to an optoelectrical power conversion system. The device may be connected to optical power sources, distributed and/or point fiber optic sensing systems on the surface and the target propulsion rate may be controlled using the transmitted optical power. This may occur when an apparatus is inserted into a wellbore where a propulsion device may propel a disposable fiber tool while the disposable fiber is deployed in the well as the tool progresses in the well. The system may be combined with batteries, large capacitor banks and/or fluid pumping as needed. Batteries for such a system may be used for maintaining memory and possibly used with power filtering. In certain instance, battery power may not be used to power propulsion of a tool.

Remote optical pumping, or photonic power, is optical power transmitted from what may be classified as a "high-power" (e.g., several watts to more than a kilowatt) optical source, transmitted using a suitable optical fiber and converted to electrical power using a suitable photovoltaic cell (e.g., a semiconductor device that converts optical energy to electrical energy). Such photovoltaic cell may be made using materials such as gallium arsenide, indium phosphide or indium gallium arsenide, or other types of semiconductor materials. The power optical source may be a power optical laser diode. Alternatively, or additionally, fiber laser based systems may use multiple laser diodes that in a multiplexed an amplification medium. An example of an amplification medium includes a cladding pumped fiber amplifier (CPFA). The system operating wavelength, fiber properties, number of multi-mode pump lasers, and other system characteristics may be selected based on the required power draw of a particular deployment tool.

Figure 5:
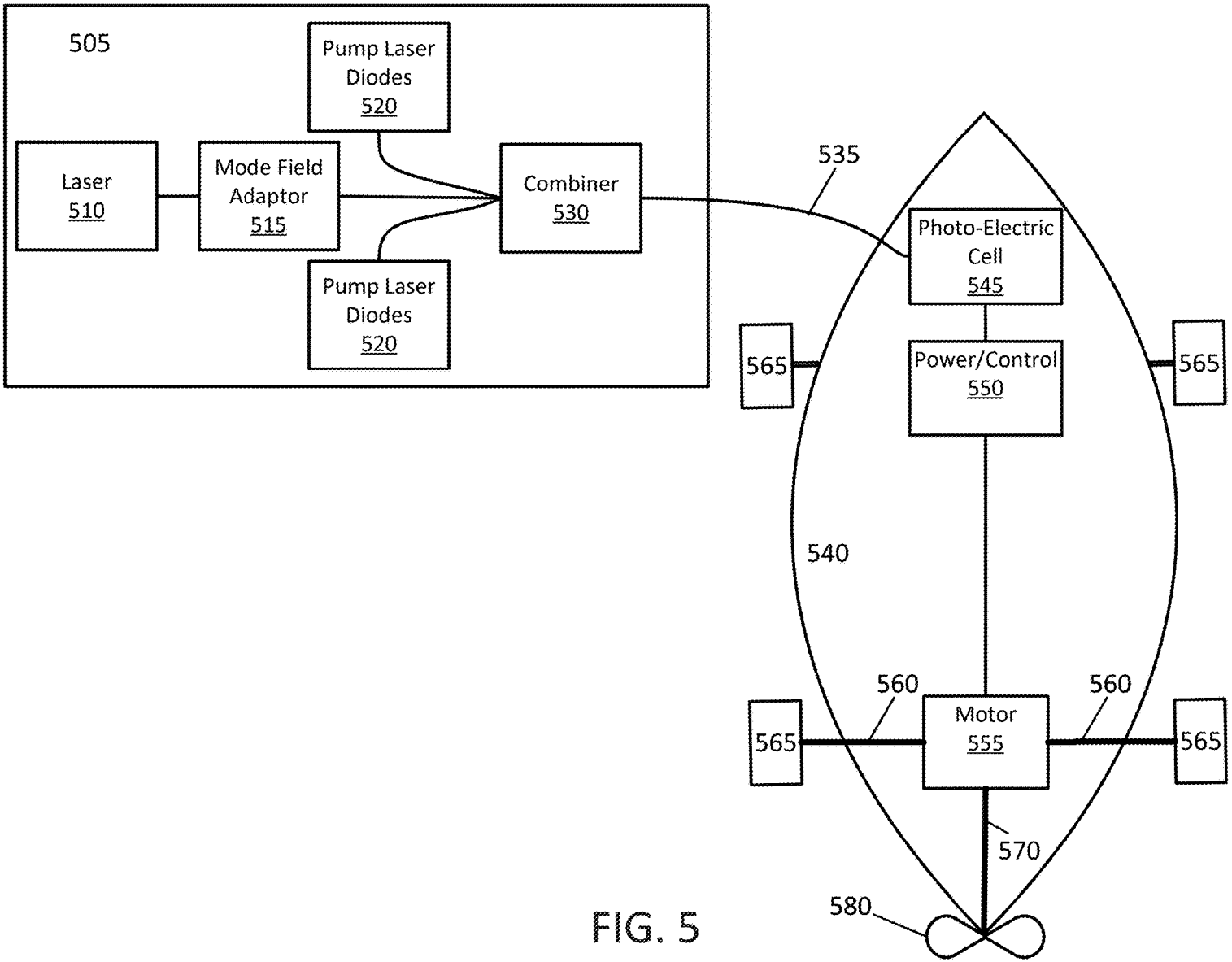
FIG. 5 illustrates devices that may be used to distribute power to devices located at a wellbore apparatus, in accordance with various aspects of the subject technology.

FIG. 5 illustrates devices that may be used to distribute power to devices located at a wellbore apparatus. An apparatus 540 may include one or more of the features discussed in respect to the fiber dispensing apparatus discussed in respect to FIG. 3. Power may be provided to a photo-electric transformer cell or generator 545 at apparatus 540 from power laser device 505 via fiber optic cable 535. Such a photo-electric transformer cell may be referred to as an optoelectrical converter as it converts light into electrical energy. Power laser device includes laser 510 that may be referred to as a preamplifier that provides laser light to model field adaptor 515 that matches a size of a laser beam from laser 510 to correspond to the size of an element of a fiber optic cable. Light from one or more sets of pumped laser diodes 520 and light from mode field adaptor 515 may be combined in combiner 530. Pumped laser diodes 520 may have the same wavelength of different wavelengths depending on how the light from multiple pump lasers is combined in combiner 530. Combiner 530 may be selected from a set of pump combiners that may be designed to scale light power systems up into the kilowatt range. Examples of such combiners include fused fiber combiners, wavelength division multiplexers, polarization combiners, end clad-pump and side clad-pumped combiners. Light from combiner 530 may be provided to one or more elements of fiber optic cable 535 and that light may shine on photo-electric generator 545. Electrical power converted by photo-electric generator 545 may be provided to a set of power and/or control circuits 550. This power may be used to power motor 555 to power one or more sets of wheels 565 or a propeller/impeller 580. Drive shaft 560 may be used to provide mechanical power from motor 555 to wheels 565. Alternatively, or additionally, mechanical power may be provided to propeller/impeller 580 via shaft 570.

In certain instances, apparatus 540 may include arms that are deployed such that wheels 565 or tracks physically contact a side of the wellbore (e.g., an inner portion of a wellbore casing). For example, drive shaft 560 may be configured to extend in length when a deployment assembly is engaged. Such an assembly may be spring loaded. Wheels 565 may be forced to press against the inner portion of a wellbore casing once deployed. Friction between wheels 565 and the casing may be used to limit the velocity of the apparatus when the apparatus is deployed in a vertical position. As such, wheels 565 or tracks may be used to resist a gravitational force along a vertical direction of the wellbore. This friction may also assist a propulsion device of the present disclosure to control movement of the apparatus along the wellbore at constant or predetermined velocity. Activating wheels 565 or tracks may allow apparatus 540 to move down a vertical portion of the wellbore or along a horizontal portion of the wellbore.

An end cap may be included at the distal end of fiber optic cable 535, this distal endcap could be some form of mode field adapter and the output fiber could be spliced to one of the fibers in the self-propelled disposable fiber deployment tool (e.g., apparatus 540) utilizing photonic power for propulsion. The pre-amplifier (laser) 520 may be connected to a fiber optic sensing system, or it may be replaced with a fiber optic sensing system or a wavelength division multiplexer (WDM) connected to two or more sensing systems.

Lasers that may be used in such applications may be selected from available lasers. Examples include laser capable of providing a few hundred milliwatts of energy and lasers that can provide 1.6 kilowatts of energy. As such, neodymium yttrium aluminum garnet (Nd:YAG) lasers may be deployed for investigating downhole drilling using laser ablation. The systems are also capable of a wide range of pulse widths and repetition rates. The Nd:YAG laser would be one potential choice for future development and tests due to its optical fiber delivering capacity. Wavelength converters may be used to convert pump wavelengths into wavelengths suitable for optimum use with photovoltaic device operating wavelengths. Various optical semiconductor based, or optical fiber-based laser sources are available up tens of kilowatts of optical power. Source characteristics like laser linewidth may be selected to control non-linear effects like stimulated Raman scattering or stimulated Brillouin scattering or other non-linear fiber effects where combinations of pulse properties (power spectral density) and fiber properties (mode field diameter) may be selected to meet the needs for various applications.

The power/control circuits of apparatus 540 may include a power storage device (e.g., a battery or supercapacitor) that may be charged with power derived from photo-electric generator 545. Apparatus 540 may also include one or more of a memory, a processor that executes instructions out of a memory, a field programmable gate array (FPGA), or a application specific integrated circuit (ASIC). While FIG. 5 illustrates light-based power distribution circuits, apparatus consistent with the present disclosure may not include such a light-based power source. As such, apparatus of the present disclosure may be powered by devices such as a battery.

One or more different fiber optic elements may be used to deliver power to an apparatus and each of these fiber optic elements may use a different wavelength of light or different power levels. The amount of power delivered to apparatus 540 may be varied to control the velocity of movement of apparatus 540. Less optical power delivered to the photo-electric generator 545 may result in less power being provided to motor 555.

Alternatively, or additionally, elements of fiber optic cable 535 may send encoded data to circuits of apparatus 540 and this data may adjust operation of motor 555 to control the velocity of apparatus 540. Data sent to circuits of apparatus 540 may allow other types of equipment to be controlled. For example, a pump or other apparatus may be deployed that directs fracturing fluid into a specific set of fractures, charges may be deployed directly into fractures, apparatus may be used to accelerate particles of specific densities into fractures, or other operations may be performed by devices included in apparatus 540. Amplitude modulation of the optical power may be used to communicate commands to circuits of apparatus 540.

The optical fiber may be connected at the surface prior to launching an optically energized and electrically propelled disposable fiber deployment tool where the system may be wavelength division multiplexed to operate multiple systems simultaneously. As such power may be distributed while a distributed fiber optic sensing system(s) and/or single point sensing systems and/or communicate with a control system. The optical fiber or fibers may be monitored (as discussed in respect to FIGS. 2 and 4) in real-time or near real-time using surface distributed fiber optic sensing instrumentation. As such, it is possible to monitor how much fiber is left in the fiber dispensing tool and how much fiber has been deployed. As discussed above in respect to FIG. 4, collected data can be used to determine the velocity of the fiber tool and a general location of the tool.

One fiber within the fiber tool may be used for communication where control commands may be transmitted to the electro-mechanical system in order to control the deployment of the self-propelled tool. Status information identifying battery power level, propulsion rate, internal tool temperature, etc. may be communicated to the surface. The system may be configured to have rest states where a battery and/or capacitor bank may be charged to generate higher thrust than a steady state power configuration may be able to deliver.

The disposable tool system may have wheels, rollers, or tracks positioned on the outside of the tool package to reduce friction and this associated power to propel the tool to a desired wellbore location. The tool may have a buoyancy profile that keeps a specific tool alignment based on gravity thus enabling a predictable mechanical configuration where the denser part of the tool may touch the lower part of the casing with more friction reducing devices. The tool may also have fins to control the fluid path in order to mitigate rotation or the tool may have multiple propulsion devices. Some designs may include propulsion mechanisms with one or more predefined rotations and external fins to allow the tool to rotate in controlled ways while enabling forward movement. The external fins and propulsion mechanism may enable fluid flow associated with the propulsion to be routed radially while the fiber optic cable is released from the center line of the tool. This may allow the cable from being directly exposed to fluid flows. Any rotational movement may be designed to offset or augment any fiber pre-tension of the internal fiber coil.

The knowledge of system properties, battery power status, propulsion rate, velocity of the disposable fiber tool and location in the wellbore, etc. may be used to calculate optimal setpoints for the electro-mechanical propulsion system for a given target deployment depth. The tool may be propelled using energy from any onboard energy storage in instances when the optical power is temporarily or permanently disconnected at any time during deployment. The tool may also be configured to be pumped into the well if the electrical propulsion system fails.

Techniques of the present disclosure may include estimating a power loss associated with transmitting laser power through a particular type of fiber optic cable configuration. This may include identifying a total power loss associated with cable length. When the fiber optic cable is deployed using a spool or other similar device, the length of the cable may not change as portions of the cable would either be wound around the spool or deployed in the wellbore. Estimates of power delivered to wellbore apparatus may also be estimated based on one or more wellbore temperatures. This is because efficiencies of power transmission and power conversion may vary with temperature. Circuits at a deployed apparatus may also measure delivered power or power provided to motors or other circuits or devices deployed with the apparatus. Data identifying the received power and/or used power may be sent uphole to a computer via one or more elements of the fiber optic cable. It is anticipated that power transfer efficiencies (light power input to power output) may meet or exceed 65%. Such estimates may be validated or refined based on data collected in one or more wellbores. Other sensing means may include using a length of optical sensing fiber in the coil in close proximity with the deployment vehicle and use DTS data for monitoring propulsion mechanism temperature or use DAS to monitor acoustic emissions from the propulsion system or use point sensors like, for example, temperature, vibration or strain to monitor the health of the system to enable control actions.

Techniques of the present disclosure may also include determining whether a deployment is complete and stopping operations with the deployment is complete. When a deployment is not complete, determinations may be made as to whether the deployment is on target (e.g., adheres to a deployment plan within a threshold level). Determinations may be made as to whether a position of the deployed apparatus is on target and this may result in adjustments being made to that position (e.g., moving further down or back up the wellbore), may result in stopping the apparatus at a location, and/or may result in a secondary operation being performed. Since batteries and fuel sources add weight and volume to self-powered systems, systems consistent with the present disclosure may not rely on or use batteries or other fuel sources.

Systems and techniques of the present disclosure may use a modular stand-alone system housing and one or more fiber optic interrogators. These interrogator(s) may be connected to a computer where data provided to that computer may be processed, filtered and decimated. The data may then be further processed using machine learning based or other data driven models. Data from multiple wells may be collected in real-time where each well may be interrogated using a stand-alone system. The data from multiple stand-alone systems may be transmitted to a central computing platform or a cloud computing environment where a subsurface representation of the fracturing operation may be displayed substantially in real-time. This subsurface representation may include subsurface models, fracture treatment data, predicted fracture propagation based on models, actual fracture propagation based on measured data etc. where fracture properties include fracture growth rate, azimuth, height and width.

Other variations include a self-propelled disposable fiber deployment tool that may also include a pressure gauge for monitoring wellbore pressure. Well interference may also be evaluated. This may include identifying where fractures grow from a treatment well to a monitoring well. Since approaching fractures may generate a pressure response when they approach and intersect a monitoring well, this pressure response may be measured using the fiber optic cable and the pressure may be used to calculate values such as pumped volume. This may help characterize interference between two wells, such information may be used to forecast communication or interconnections between wells in future stages and this information may be used to modify future stage designs.

The pressure gauge data and/or disposable fiber data may in some instances also be evaluated to identify parameters associated with near wellbore complexity. A pressure pulse may be generated at the surface in a monitoring well, and the system may measure the evolution of a pressure pulse as it travels down the wellbore. Fluids that exit/enter the wellbore at perforations and the magnitude of the fluid movement may depend on the flow resistance in the near wellbore. Such fluid movement may be measured or otherwise analyzed using Rayleigh, Brillouin and/or fiber Bragg grating based technology. The velocity and amplitude of the pressure pulse may change depending on the near wellbore complexity of the fractures, and such velocities or amplitudes may be used as a measure of fracturing operations efficiency.

The fiber deployed in a fractured well for monitoring purposes may also be used to measure fluid communication between two fractured wells where the first fractured well may be instrumented with a self-propelled disposable fiber. A pressure pulse may be generated in a second fractured well. Any open fluid path between the two wells may generate a fluid movement in the first well instrumented with optical fiber. Collected data may be used to optimize well spacing between future well pairs and/or used to modify future stage designs and/or fracturing operations.

A fracturing operation may include pressure pulse monitoring in the treatment well to determine near-wellbore complexity and disposable fiber deployed in sealed wellbores, wellbores open to the formation at the distal end (toe end), previously fractured wells where the wells may be vertical, horizontal or a combination thereof.

Once fiber optic cables are deployed in a wellbore, data may be collected from which computer modeling may be used to identify properties strata near the wellbore. Data may be collected as fracturing operations are performed at adjacent wellbores and the extent or growth of fractures may be identified by one or more processors that execute instructions of the computer models. A control computer or other apparatus may receive input from a central computing platform or a cloud computing environment where data, measured and/or modeled data, results, predictions, recommended and/or real-time control actions may be part of the input. The input may also include quality/uncertainty metrics for results with alarms for data quality where gaps may be identified in terms of monitoring coverage with recommended sensor deployment options to cover said gaps. Properly instrumented frac pads and reservoirs with an automated workflow may generate input to a fracturing spread control system thus enabling more efficient fracturing control. Various metrics may be monitored and control systems may identify whether those metrics correspond to a fracturing plan with a threshold value or range.

True Distributed Fiber Optic Sensing (DFOS) systems may operate based on e.g. Optical Time Domain Reflectometry (OTDR) principles or Optical Frequency Domain Reflectometry (OFDR). OTDR based systems are pulsed where one or more optical pulses may be transmitted down an optical fiber and backscattered light (Rayleigh, Brillouin, Raman etc.) is measured and processed. Time of flight for the optical pulse(s) indicate where along the optical fiber the measurement is done. OFDR based systems operate in continuous wave (CW) mode where a tunable laser is swept across a wavelength range, and the back scattered light is collected and processed.

Various hybrid approaches where single point, quasi-distributed, or distributed fiber optic sensors may be mixed with other sensors (e.g., electrical sensors). The fiber optic cable may include optical fiber and electrical conductors. Electrical sensors may be pressure sensors based on quarts type sensors or strain gauge based sensors or other commonly used sensing technologies. Pressure, optical or electrical sensors may be housed in dedicated gauge mandrels or attached outside the casing in various configurations for down-hole deployment or such sensors may be deployed conventionally at the surface well head or flow lines.

Temperature measurements from a DTS system may be used to determine locations for fluid (e.g., water) injection applications. Such locations may correspond to areas where fluid inflow from the surface may be cooler than formation temperatures. In certain instance, warm-back analyses may be used to determine fluid volume placement, this may be done for water injection wells or fracturing fluid placement. Temperature measurements in observation wells can be used to determine fluid communication between the treatment well and an observation well. Such techniques may be used to identify how fluids flow in a formation.

Sensor data may be used to identify fluid allocation in real-time as acoustic noise is generated when fluid flows through the casing and in through perforations into the formation. Phase and intensity based interferometric sensing systems are sensitive to temperature and mechanical movements as well as acoustically induced vibrations. Sensed data may be converted from time series date to frequency domain data using Fast Fourier Transforms (FFT) and other transforms like wavelet transforms may also be used to generate different representations of the data. Various frequency ranges can be used for different purposes and where signals below a threshold frequency may be used to identify changes associated with a formation. For example, strain changes or temperature changes due to fluid movement and other frequency ranges may be indicative of fluid or gas movement. Various filtering techniques and models may be applied to generate indicators of events that may be of interest. Indicators may include formation movement due to growing natural fractures, formation stress changes during fracturing operations (stress shadowing), fluid seepage during the fracturing operation (as formation movement may force fluid into an observation well). Sensing apparatus may be used to detect fluid flow from fractures or fluid and proppant flows. Each indicator may have a characteristic signature in terms of frequency content and/or amplitude and/or time dependent behavior. Fiber optic cables used with such systems may include enhanced back scatter optical fibers where Rayleigh backscatter may be increased by 10× or more with associated increase in Optical Signal to Noise Ratio (OSNR).

Distributed acoustic systems (DAS) may be used to detect various seismic events where stress fields and/or growing fracture networks, generate microseimic events, or determine where perforation charges be used to identify travel time between horizontal wells. Such information may be used from stage to stage to determine changes in travel time as the formation is fractured and filled with fluid and proppant. The DAS systems may also be used with surface seismic sources to generate Vertical Seismic Profiles (VSPs) before, during and after a fracturing job to determine the effectiveness of the fracturing job as well as determine production effectiveness. VSPs and reflection seismic surveys may be used over the life of a well and/or reservoir to track production related depletion and/or track e.g. water/gas/polymer flood fronts.

Distributed strain sensing (DSS) data can be generated using various approaches and static strain data can be used to determine absolute strain changes over time. Static strain data may be measured using Brillouin based systems or quasi-distributed strain data from a fiber Bragg grating based system. Static strain may also be used to determine propped fracture volume by looking at deviations in strain data from a measured strain baseline before fracturing a stage. It may also be possible to determine formation properties like permeability, poro-elastic responses, and leak off rates based on the change of strain vs time and the rate at which the strain changes over time. Dynamic strain data can be used in real-time to detect fracture growth through an appropriate inversion model, and appropriate actions like dynamic changes to fluid flow rates in the treatment well, addition of diverters or chemicals into the fracturing fluid, or changes to proppant concentrations or types can then be used to mitigate detrimental effects.

Fiber Bragg Grating (FBG) based systems may also be used for a number of different measurements. FBG's are partial reflectors that can be used as temperature and strain sensors, or FBGs can be used to make various interferometric sensors with very high sensitivity. FBGs can be used to make point sensors or quasi-distributed sensors where these FBG based sensors can be used independently or with other types of fiber optic-based sensors. FBGs can be manufactured into an optical fiber at a specific wavelength, and other DAS, DSS or distributed temperatures sensing (DTS) systems may operate at different wavelengths in the same fiber and measure different parameters simultaneously. A FBG based system may use Wavelength Division Multiplexing (WDM) and/or Time Division Multiplexing (TDM).

The sensors can be placed in either the treatment well or monitoring well(s) to measure well communication. A treatment well may be a well where fracturing fluids are provided and monitoring well may be a well where data is sensed. Metrics that may be monitored include treatment well pressure, flow rate, proppant concentration, and diverter flow. Fluids and chemicals may be altered to change hydraulic fracturing treatment process. These changes may impact the formation responses in several different ways. For example strain/stress fields may change and such changes may result in the generation of microseismic events. Such events may be measured with DAS systems and/or single point seismic sensors like geophones or accelerometers.

Fracture growth rates may change over time and this can generate changes in measured microseismic events and event distributions over time. Changes in measured strain may also be used to determine fracture growth, and frequency analysis based on sensed data may be used to differentiate between near field and far field fracture growth. Pressure changes due to poroelastic effects may be measured in the monitoring well and be used to determine fracture growth. Pressure data may be measured in the treatment well and correlated to measured formation responses. Various changes in treatment rates and pressure may generate events that can be correlated to fracture growth rates Several measurements can be combined to determine adjacent well communication, and this information can be used to change the hydraulic fracturing treatment schedule to generate desired outcomes. Multiple wells in a field and/or reservoir may be instrumented with optical fibers for monitoring subsurface reservoirs from cradle to grave. Subsurface applications may include hydrocarbon extraction, geothermal energy production and/or fluid injection like water or CO2 in carbon capture and utilization & storage applications.

Near real-time data processing of microseismic data may be required to enable a closed-loop hydraulic fracturing control system. This may include controlling the fracture equipment to manage injection rates, pressures, chemicals, proppant concentration to achieve certain objectives e.g., avoiding or controlling well interference where fractures from the treatment well connect with other existing well bores. Real-time microseismic data and other real-time data, e.g., strain-based and pressure-based data streams, may be combined to reduce uncertainty and be used as input for controlling the fracturing operation. The optical sensing fibers may be permanently installed in a treatment well or a monitoring well or deployed using retrievable or disposable technology in a monitoring well.

Figure 6:
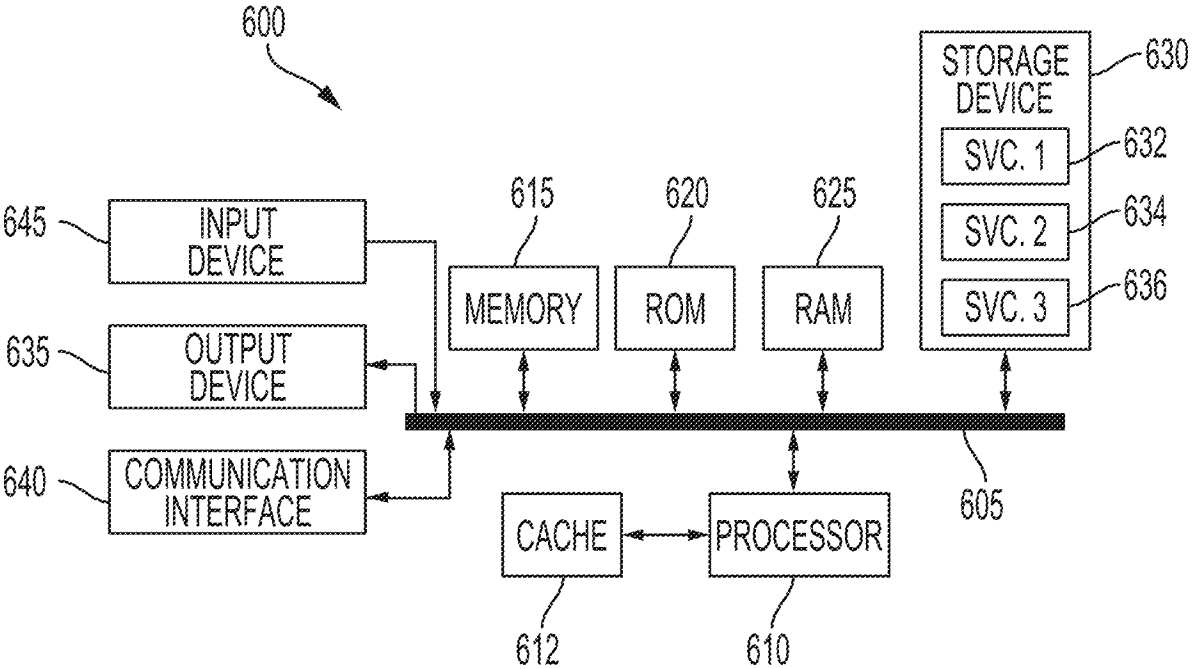
FIG. 6 illustrates an example computing device architecture which can be employed to perform any of the systems and techniques described herein.

FIG. 6 illustrates an example computing device architecture which can be employed to perform any of the systems and techniques described herein. In some examples, the computing device architecture 600 can be integrated with tools described herein. The components of the computing device architecture 600 are shown in electrical communication with each other using a connection 605, such as a bus. The example computing device architecture 600 includes a processing unit (CPU or processor) 610 and a computing device connection 605 that couples various computing device components including the computing device memory 615, such as read only memory (ROM) 620 and random access memory (RAM) 626, to the processor 610.

The computing device architecture 600 can include a cache of high-speed memory connected directly with, in close proximity to, or integrated as part of the processor 610. The computing device architecture 600 can copy data from the memory 615 and/or the storage device 630 to the cache 612 for quick access by the processor 610. In this way, the cache can provide a performance boost that avoids processor 610 delays while waiting for data. These and other modules can control or be configured to control the processor 610 to perform various actions. Other computing device memory 615 may be available for use as well. The memory 615 can include multiple different types of memory with different performance characteristics. The processor 610 can include any general-purpose processor and a hardware or software service, such as service 1 632, service 2 634, and service 3 636 stored in storage device 630, configured to control the processor 610 as well as a special-purpose processor where software instructions are incorporated into the processor design. The processor 610 may be a self-contained system, containing multiple cores or processors, a bus, memory controller, cache, etc. A multi-core processor may be symmetric or asymmetric.

To enable user interaction with the computing device architecture 600, an input device 645 can represent any number of input mechanisms, such as a microphone for speech, a touch-sensitive screen for gesture or graphical input, keyboard, mouse, motion input, speech and so forth. An output device 635 can also be one or more of a number of output mechanisms known to those of skill in the art, such as a display, projector, television, speaker device, etc. In some instances, multimodal computing devices can enable a user to provide multiple types of input to communicate with the computing device architecture 600. The communications interface 640 can generally govern and manage the user input and computing device output. There is no restriction on operating on any particular hardware arrangement and therefore the basic features here may easily be substituted for improved hardware or firmware arrangements as they are developed.

Storage device 630 is a non-volatile memory and can be a hard disk or other types of computer readable media which can store data that are accessible by a computer, such as magnetic cassettes, flash memory cards, solid state memory devices, digital versatile disks, cartridges, random access memories (RAMs) 625, read only memory (ROM) 620, and hybrids thereof. The storage device 630 can include services 632, 634, 636 for controlling the processor 610. Other hardware or software modules are contemplated. The storage device 630 can be connected to the computing device connection 605. In one aspect, a hardware module that performs a particular function can include the software component stored in a computer-readable medium in connection with the necessary hardware components, such as the processor 610, connection 605, output device 635, and so forth, to carry out the function.

For clarity of explanation, in some instances the present technology may be presented as including individual functional blocks including functional blocks comprising devices, device components, steps or routines in a method implemented in software, or combinations of hardware and software.

In some instances, the computer-readable storage devices, mediums, and memories can include a cable or wireless signal containing a bit stream and the like. However, when mentioned, non-transitory computer-readable storage media expressly exclude media such as energy, carrier signals, electromagnetic waves, and signals per se.

Methods according to the above-described examples can be implemented using computer-executable instructions that are stored or otherwise available from computer readable media. Such instructions can include, for example, instructions and data which cause or otherwise configure a general purpose computer, special purpose computer, or a processing device to perform a certain function or group of functions. Portions of computer resources used can be accessible over a network. The computer executable instructions may be, for example, binaries, intermediate format instructions such as assembly language, firmware, source code, etc. Examples of computer-readable media that may be used to store instructions, information used, and/or information created during methods according to described examples include magnetic or optical disks, flash memory, USB devices provided with non-volatile memory, networked storage devices, and so on.

Devices implementing methods according to these disclosures can include hardware, firmware and/or software, and can take any of a variety of form factors. Typical examples of such form factors include laptops, smart phones, small form factor personal computers, personal digital assistants, rackmount devices, standalone devices, and so on. Functionality described herein also can be embodied in peripherals or add-in cards. Such functionality can also be implemented on a circuit board among different chips or different processes executing in a single device, by way of further example.

The instructions, media for conveying such instructions, computing resources for executing them, and other structures for supporting such computing resources are example means for providing the functions described in the disclosure.

In the foregoing description, aspects of the application are described with reference to specific examples and aspects thereof, but those skilled in the art will recognize that the application is not limited thereto. Thus, while illustrative examples and aspects of the application have been described in detail herein, it is to be understood that the disclosed concepts may be otherwise variously embodied and employed, and that the appended claims are intended to be construed to include such variations, except as limited by the prior art. Various features and aspects of the above-described subject matter may be used individually or jointly. Further, examples and aspects of the systems and techniques described herein can be utilized in any number of environments and applications beyond those described herein without departing from the broader spirit and scope of the specification. The specification and drawings are, accordingly, to be regarded as illustrative rather than restrictive. For the purposes of illustration, methods were described in a particular order. It should be appreciated that in alternate examples, the methods may be performed in a different order than that described.

Where components are described as being "configured to" perform certain operations, such configuration can be accomplished, for example, by designing electronic circuits or other hardware to perform the operation, by programming programmable electronic circuits (e.g., microprocessors, or other suitable electronic circuits) to perform the operation, or any combination thereof.

The various illustrative logical blocks, modules, circuits, and algorithm steps described in connection with the examples disclosed herein may be implemented as electronic hardware, computer software, firmware, or combinations thereof. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present application.

The techniques described herein may also be implemented in electronic hardware, computer software, firmware, or any combination thereof. Such techniques may be implemented in any of a variety of devices such as general purposes computers, wireless communication device handsets, or integrated circuit devices having multiple uses including application in wireless communication device handsets and other devices. Any features described as modules or components may be implemented together in an integrated logic device or separately as discrete but interoperable logic devices. If implemented in software, the techniques may be realized at least in part by a computer-readable data storage medium comprising program code including instructions that, when executed, performs one or more of the method, algorithms, and/or operations described above. The computer-readable data storage medium may form part of a computer program product, which may include packaging materials.

The computer-readable medium may include memory or data storage media, such as random access memory (RAM) such as synchronous dynamic random access memory (SDRAM), read-only memory (ROM), non-volatile random access memory (NVRAM), electrically erasable programmable read-only memory (EEPROM), FLASH memory, magnetic or optical data storage media, and the like. The techniques additionally, or alternatively, may be realized at least in part by a computer-readable communication medium that carries or communicates program code in the form of instructions or data structures and that can be accessed, read, and/or executed by a computer, such as propagated signals or waves.

Methods and apparatus of the disclosure may be practiced in network computing environments with many types of computer system configurations, including personal computers, hand-held devices, multi-processor systems, microprocessor-based or programmable consumer electronics, network PCs, minicomputers, mainframe computers, and the like. Such methods may also be practiced in distributed computing environments where tasks are performed by local and remote processing devices that are linked (either by hardwired links, wireless links, or by a combination thereof) through a communications network. In a distributed computing environment, program modules may be located in both local and remote memory storage devices.

In the above description, terms such as "upper," "upward," "lower," "downward," "above," "below," "downhole," "uphole," "longitudinal," "lateral," and the like, as used herein, shall mean in relation to the bottom or furthest extent of the surrounding wellbore even though the wellbore or portions of it may be deviated or horizontal. Correspondingly, the transverse, axial, lateral, longitudinal, radial, etc., orientations shall mean orientations relative to the orientation of the wellbore or tool.

The term "coupled" is defined as connected, whether directly or indirectly through intervening components, and is not necessarily limited to physical connections. The connection can be such that the objects are permanently connected or releasably connected. The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape or another word that substantially modifies, such that the component need not be exact. For example, substantially cylindrical means that the object resembles a cylinder, but can have one or more deviations from a true cylinder.

The term "radially" means substantially in a direction along a radius of the object, or having a directional component in a direction along a radius of the object, even if the object is not exactly circular or cylindrical. The term "axially" means substantially along a direction of the axis of the object. If not specified, the term axially is such that it refers to the longer axis of the object.

Although a variety of information was used to explain aspects within the scope of the appended claims, no limitation of the claims should be implied based on particular features or arrangements, as one of ordinary skill would be able to derive a wide variety of implementations. Further and although some subject matter may have been described in language specific to structural features and/or method steps, it is to be understood that the subject matter defined in the appended claims is not necessarily limited to these described features or acts. Such functionality can be distributed differently or performed in components other than those identified herein. The described features and steps are disclosed as possible components of systems and methods within the scope of the appended claims.

Claim language or other language in the disclosure reciting "at least one of" a set and/or "one or more" of a set indicates that one member of the set or multiple members of the set (in any combination) satisfy the claim. For example, claim language reciting "at least one of A and B" or "at least one of A or B" means A, B, or A and B. In another example, claim language reciting "at least one of A, B, and C" or "at least one of A, B, or C" means A, B, C, or A and B, or A and C, or B and C, or A and B and C. The language "at least one of" a set and/or "one or more" of a set does not limit the set to the items listed in the set. For example, claim language reciting "at least one of A and B" or "at least one of A or B" can mean A, B, or A and B, and can additionally include items not listed in the set of A and B.

Illustrative Aspects of the disclosure include:

Aspect 1: A method comprising controlling optical light power provided to an opto-electric converter of an apparatus when a fiber optic cable is deployed in a wellbore; converting a portion of the optical light power to electrical energy based on operation of the opto-electric converter; powering a propulsion device of the apparatus when the opto-electric converter converts the portion of the optical light power to the electrical energy; and controlling movement of the apparatus along the wellbore based on operation of the propulsion device.

Aspect 2: The method of Aspect 1, further comprising maintaining a power level of the optical light power provided to the apparatus when a velocity of the apparatus is maintained.

Aspect 3: The method of any of Aspects 1 and 2, wherein the controlling of the optical light power includes: increasing an intensity of the optical light power provided to the opto-electric converter to increase a power level of the electrical energy provided to the propulsion device of the apparatus; and decreasing the intensity of the optical light power provided to the opto-electric converter to decrease the power level of the electrical energy provided to the propulsion device of the apparatus.

Aspect 4: The method of any of Aspects 1 through 3, further comprising deploying arms of an assembly such that portions of the assembly contact a side of the wellbore, wherein the portions of the assembly resist a gravitational force along a vertical direction of the wellbore.

Aspect 5: The method of any of Aspects 4, wherein the portions of the assembly include wheels.

Aspect 6: The method of any of Aspects 1 through 5, wherein at least a portion of energy that powers the propulsion device is provided by an energy storage device, and the energy storage device includes one or more of a battery or a supercapacitor.

Aspect 7: The method of any of Aspects 1 through 6, further comprising receiving light signals associated with the deployment of the fiber optic cable; extracting data from the light signals; and identifying one or more characteristics from the extracted data, wherein the movement of the apparatus is controlled based on one or more characteristics associated with the extracted data and a force provided by the propulsion device.

Aspect 8: The method of Aspect 7, wherein the one or more characteristics include at least one of a velocity of the apparatus moving along the wellbore or a deployment distance of the fiber optic cable.

Aspect 9: A system comprising: an apparatus configured to be placed in a wellbore; a fiber optic cable that is deployed with the apparatus; a laser that provides optical light to power to an element of the fiber optic cable; an opto-electric converter that converts a portion of the optical light power provided by the laser to electrical energy; and a propulsion device that is powered when the opto-electric converter converts the portion of the optical light power to the electrical energy, wherein movement of the apparats along the wellbore is controlled based on operation of the propulsion device.

Aspect 10: The system of Aspect 9, wherein a power level of the optical light power provided to the apparatus is maintained when a velocity of the apparatus is maintained.

Aspect 11: The system of Aspect 9 or 10, wherein the optical light power is controlled by: increasing an intensity of the optical light power provided to the opto-electric converter to increase a power level of the electrical energy provided to the propulsion device of the apparatus; and decreasing the intensity of the optical light power provided to the opto-electric converter to decrease the power level of the electrical energy provided to the propulsion device of the apparatus.

Aspect 12: The system of any of Aspects 9 through 11, further comprising arms of an assembly that are deployed such that portions of the assembly contact a side of the wellbore, wherein the portions of the assembly resist a gravitational force along a vertical direction of the wellbore.

Aspect 13: The system of Aspect 12, wherein the portions of the assembly include wheels.

Aspect 14: The system of any of Aspects 9 through 12, further comprising an energy storage device that includes one or more of a battery or a supercapacitor, wherein at least a portion of energy that powers the propulsion device is provided by the energy storage device.

Aspect 15: The system of any of Aspects 9 through 14, further comprising a receiving device that receives light signals associated with the deployment of the fiber optic cable, wherein data is extracted from the light signals; a memory; and one or more processors that execute instructions out of the memory to identify one or more characteristics from the extracted data, wherein the movement of the apparatus is controlled based on one or more characteristics associated with the extracted data and a force provided by the propulsion device.

Aspect 16: The system of Aspect 15, wherein the one or more characteristics include at least one of a velocity of the apparatus moving along the wellbore or a deployment distance of the fiber optic cable.

Aspect 17: A non-transitory computer-readable storage medium having embodied thereon instructions executable by one or more processors to control optical light power provided to an opto-electric converter of an apparatus when a fiber optic cable is deployed in a wellbore, wherein a portion of the optical light power is converted to electrical energy based on operation of the opto-electric converter, and a propulsion device of the apparatus is powered when the opto-electric converter converts the portion of the optical light power to the electrical energy; and wherein movement of the apparatus along the wellbore is controlled.

Aspect 18: The non-transitory computer-readable storage medium of Aspect 17, wherein the one or more processors execute the instructions to maintain a power level of the optical light power provided to the apparatus when a velocity of the apparatus is maintained.

Aspect 19: The non-transitory computer-readable storage medium of Aspect 17, wherein the optical light power is controlled by: increasing an intensity of the optical light power provided to the opto-electric converter to increase a power level of the electrical energy provided to the propulsion device of the apparatus; and decreasing the intensity of the optical light power provided to the opto-electric converter to decrease the power level of the electrical energy provided to the propulsion device of the apparatus.

Aspect 20: The non-transitory computer-readable storage medium of any of Aspects 17 through 19, wherein arms of an assembly are deployed such that portions of the assembly contact a side of the wellbore, wherein the portions of the assembly resist a gravitational force along a vertical direction of the wellbore.

What is claimed is:

1. A method comprising:

controlling optical light power provided to an opto-electric converter of an apparatus deploying a fiber optic cable in a wellbore;

converting a portion of the optical light power to electrical energy based on operation of the opto-electric converter;

powering a propulsion device of the apparatus when the opto-electric converter converts the portion of the optical light power to the electrical energy;

receiving, at the surface, light signals generated when the fiber optic cable is deployed, the light signals characterizing deployment of the fiber optic cable in the wellbore; and controlling movement of the apparatus along the wellbore based on the light signals characterizing the deployment of the fiber optic cable.

2. The method of claim 1, further comprising:

identifying a number of lasers to provide the optical light power to the opto-electric converter via the fiber optic cable based on a power requirement of the apparatus; and providing the optical light power to the opto-electric converter via the fiber optic cable based on operation of the number of lasers.

3. The method of claim 1, wherein the controlling of the optical light power includes:

increasing an intensity of the optical light power provided to the opto-electric converter to increase a power level of the electrical energy provided to the propulsion device of the apparatus;

decreasing the intensity of the optical light power provided to the opto-electric converter to decrease the power level of the electrical energy provided to the propulsion device of the apparatus; and receiving additional light signals from the fiber optic cable when the fiber optic cable acts as a distributed sensor.

4. The method of claim 1, further comprising:

deploying arms of an assembly such that portions of the assembly contact a side of the wellbore, wherein the portions of the assembly resist a gravitational force along a vertical direction of the wellbore.

5. The method of claim 4, wherein the portions of the assembly include wheels.

6. The method of claim 1, wherein at least a portion of energy that powers the propulsion device is provided by an energy storage device, and the energy storage device includes one or more of a battery or a supercapacitor.

7. The method of claim 1, further comprising:

extracting data from the light signals associated with the deployment of the fiber optic cable; and identifying at least one of a velocity of the apparatus or a deployment distance of the apparatus based on an analysis of the data extracted from the light signals, wherein the movement of the apparatus is controlled based on the identified velocity or the identified deployment distance.

8. The method of claim 7, wherein the extracted data includes a pattern that corresponds to unwrapping of the fiber optic cable from a spool.

9. A system comprising:

an apparatus configured to be placed in a wellbore;

a fiber optic cable that is deployed with the apparatus;

a laser device that provides optical light to one or more fibers of the fiber optic cable;

an opto-electric converter that converts a portion of the optical light provided by the laser to electrical energy; and a propulsion device that is powered when the opto-electric converter converts the portion of the optical light to the electrical energy, wherein:

light signals generated when the fiber optic cable is deployed are received at the surface, the light signals characterizing deployment of the fiber optic cable in the wellbore; and movement of the apparatus along the wellbore is controlled based on the light signals characterizing the deployment of the fiber optic cable.

10. The system of claim 9, wherein:

the laser device includes a number of lasers that provide the optical light power to the opto-electric converter via the fiber optic cable is identified based on a power requirement of the apparatus; and the optical light power is provided to the opto-electric converter via the fiber optic cable based on operation of the number of lasers.

11. The system of claim 9, wherein:

additional light signals are received from the fiber optic cable when the fiber optic cable acts as a distributed sensor, and the optical light power is controlled by:

increasing an intensity of the optical light power provided to the opto-electric converter to increase a power level of the electrical energy provided to the propulsion device of the apparatus; and decreasing the intensity of the optical light power provided to the opto-electric converter to decrease the power level of the electrical energy provided to the propulsion device of the apparatus.

12. The system of claim 9, further comprising:

arms of an assembly that are deployed such that portions of the assembly contact a side of the wellbore, wherein the portions of the assembly resist a gravitational force along a vertical direction of the wellbore.

13. The system of claim 12, wherein the portions of the assembly include wheels.

14. The system of claim 9, further comprising:

an energy storage device that includes one or more of a battery or a supercapacitor, wherein at least a portion of energy that powers the propulsion device is provided by the energy storage device.

15. The system of claim 9, further comprising:

a receiving device that receives the light signals characterizing the deployment of the fiber optic cable, wherein data associated with the deployment of the fiber optic cable is extracted from the light signals;

a memory; and one or more processors that execute instructions out of the memory to identify at least one of a velocity of the apparatus or a deployment distance of the apparatus based on an analysis of the data extracted from the light signals, wherein the movement of the apparatus is controlled based on the identified velocity or the deployment distance.

16. The system of claim 15, wherein the extracted data includes a pattern that corresponds to unwrapping of the fiber optic cable from a spool.

17. A non-transitory computer-readable storage medium having embodied thereon instructions executable by one or more processors to:

control optical light power provided to an opto-electric converter of an apparatus deploying a fiber optic cable in a wellbore, wherein:

a portion of the optical light power is converted to electrical energy based on operation of the opto-electric converter, a propulsion device of the apparatus is powered when the opto-electric converter converts the portion of the optical light power to the electrical energy; and light signals generated when the fiber optic cable is deployed are received at the surface, the light signals characterizing deployment of the fiber optic cable in the wellbore; and movement of the apparatus along the wellbore is controlled based on the light signals characterizing the deployment of the fiber optic cable.

18. The non-transitory computer-readable storage medium of claim 17, wherein the one or more processors execute the instructions to provide the optical light power to the opto-electric converter via the fiber optic cable based on operation of a number of lasers, and wherein the number of lasers that provide the optical light power to the opto-electric converter via the fiber optic cable are identified based on a power requirement of the apparatus.

19. The non-transitory computer-readable storage medium of claim 17, wherein the optical light power is controlled by:

increasing an intensity of the optical light power provided to the opto-electric converter to increase a power level of the electrical energy provided to the propulsion device of the apparatus;

decreasing the intensity of the optical light power provided to the opto-electric converter to decrease the power level of the electrical energy provided to the propulsion device of the apparatus; and receiving additional light signals from the fiber optic cable when the fiber optic cable acts as a distributed sensor.

20. The non-transitory computer-readable storage medium of claim 17, wherein:

arms of an assembly are deployed such that portions of the assembly contact a side of the wellbore, wherein the portions of the assembly resist a gravitational force along a vertical direction of the wellbore.

* * * * *